US009644835B2

(12) United States Patent
Yang

(10) Patent No.: US 9,644,835 B2
(45) Date of Patent: May 9, 2017

(54) TWINKLING DOOR HANGER

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 299 days.

(21) Appl. No.: 14/318,700

(22) Filed: Jun. 30, 2014

(65) Prior Publication Data

US 2015/0377478 A1 Dec. 31, 2015

(51) Int. Cl.

| | |
|---|---|
| ***F21V 33/00*** | (2006.01) |
| ***F21S 9/02*** | (2006.01) |
| *F21W 121/00* | (2006.01) |

(52) U.S. Cl.

CPC ..... *F21V 33/0028* (2013.01); *F21S 9/02* (2013.01); *F21W 2121/00* (2013.01)

(58) Field of Classification Search

CPC ..... A47G 33/08; A47G 2033/0827; F21W 2121/00; Y10S 362/808; F21V 33/0028; F21V 23/04; F21V 3/00; F21S 9/02

See application file for complete search history.

(56) References Cited

U.S. PATENT DOCUMENTS

| | | | | |
|---|---|---|---|---|
| 3,873,880 | A * | 3/1975 | Riddell | A47G 33/08 315/161 |
| 4,652,980 | A * | 3/1987 | Segan | A47G 33/0818 362/157 |
| 4,802,071 | A * | 1/1989 | Schuster | A45B 3/04 362/154 |
| 5,911,501 | A * | 6/1999 | Katz | F21V 17/164 362/124 |
| 6,341,882 | B1 * | 1/2002 | Lin | A63H 3/006 101/405 |
| 2003/0081404 | A1 * | 5/2003 | Wang | G09F 13/22 362/84 |
| 2009/0103287 | A1 * | 4/2009 | Medley | F21S 6/001 362/122 |

* cited by examiner

*Primary Examiner* — Andrew Coughlin
*Assistant Examiner* — Fatima Farokhrooz
(74) *Attorney, Agent, or Firm* — Leong C. Lei

(57) ABSTRACT

A twinkling door hanger mainly includes a main decoration, secondary decoration, illumination device and hanging portion. The secondary decoration is configured on the top of the main decoration, being different from the main decoration in material; the illumination device has at least one illumination element configured inside the main decoration; the hanging portion is configured above the main decoration, capable of being hung on a door knob, allowing the present invention to achieve a decoration profiting effect through the configuration of the illumination element.

8 Claims, 6 Drawing Sheets

TWINKLING DOOR HANGER

TECHNICAL FIELD OF THE INVENTION

The present invention relates to a door hanger decoration, and more particularly to a door hanger with an illumination structure.

DESCRIPTION OF THE PRIOR ART

People begin to have a variety of needs for the decoration of living space accompanying living style change and economic environment improvement. Among these, people diversify a space with various modeling of decorative hangings. To change surrounding atmosphere and convert mood, a variety of hangings with a small decorative object have appeared in the customer market.

However, the main bodies of decorative door hangers related to the present invention, which are usually seen in the market, includes a variety of modeling designs, but they are always limited to only one use, being lack of change and therefore losing freshness and fun after a long term use without other attached functions. Therefore, purchasing other different decorative hangings to maintain freshness and fun makes one deficiency of such kinds of decorative door hangers.

SUMMARY OF THE INVENTION

The main object of the present invention is to provide a twinkling door hanger, capable of increasing additional functions to a decorative door hanger, and allowing it to have a different visual effect.

To achieve the object mentioned above, the present invention proposes a twinkling door hanger, mainly including:

a main decoration, being a hollow, pervious-to-light shell, a through hole being formed on one side of the shell, an accepting space being formed by surrounding the accepting space with wall faces of the shell;

a secondary decoration, configured on a top of the main decoration, being different from the main decoration in material;

an illumination device, including a power source portion, in connection with a battery to generate electricity; at least one illumination element, configured in the accepting space; and a switch, adapted to switch on and off the illumination element, the illumination element and switch being in electric connection the said power source portion; and a hanging portion, configured on a upper side of the main decoration.

Whereby, when the switch is switched on and the power source portion is conducted, the light emitted from the illumination element transmits the main decoration, allowing the present invention to not only be hung on the door knob as a decoration but have a illumination guidance function at night, as such, the decoration effect of the door hanger is profited through the transmission of the illumination element.

DETAILED DESCRIPTION OF THE PREFERRED EMBODIMENTS

Figure 1:
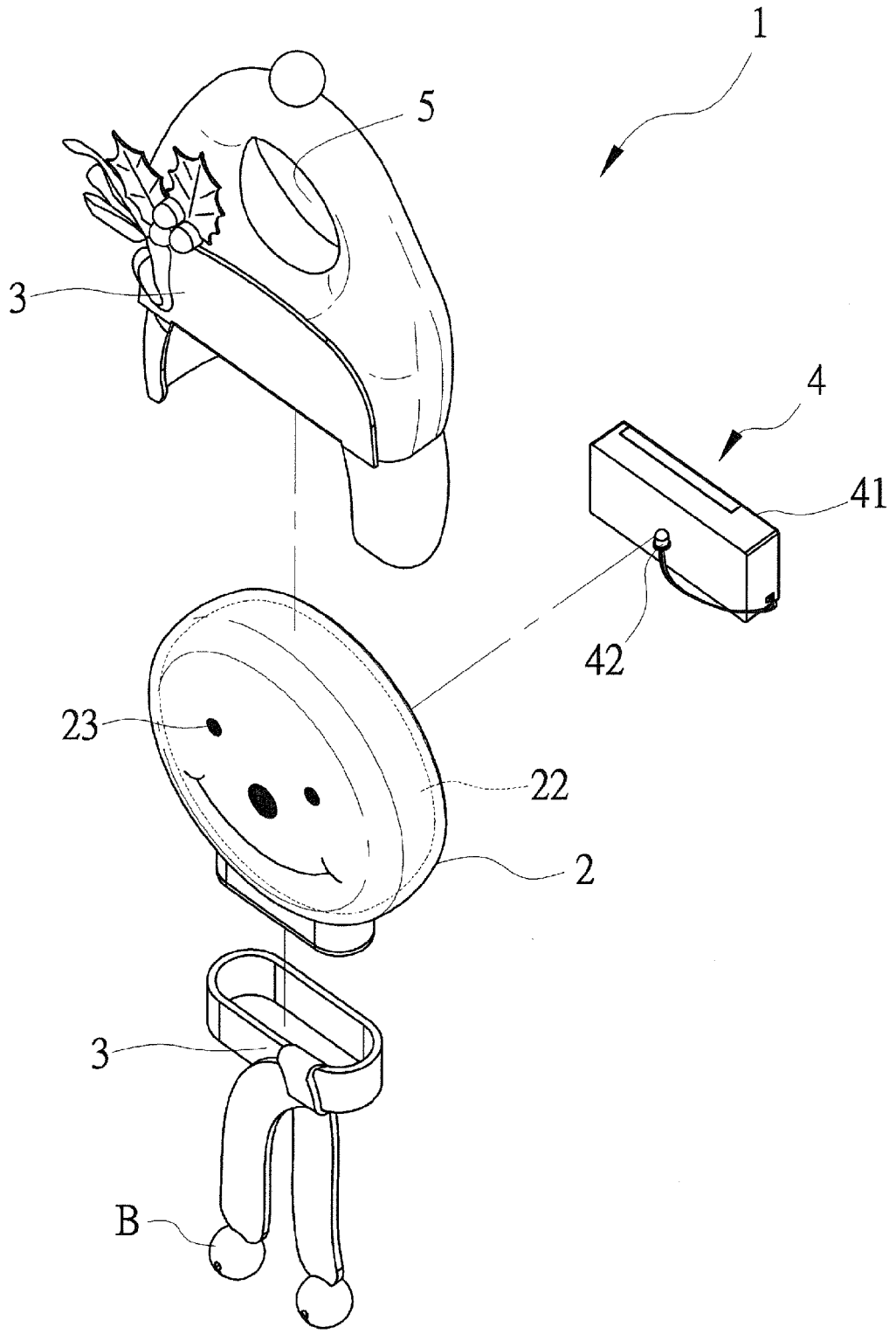
FIG. 1 is an exploded view of the present invention.

Referring to FIGS. 1 to r, which respectively are an exploded view, exploded view seeing from the rear, perspective view, perspective view in a use state of a preferred embodiment of a twinkling door hanger according to the present invention, the door hanger 1 mainly includes a main decoration 2, secondary decoration 3, illumination device 4 and hanging portion 5.

The main decoration 2 is hollow, pervious-to-light shell, one face of the shell is formed with a hole 21, and an accepting space 22 is formed by surrounding it with the wall faces of the shell. In the present embodiment, the shell is made from pervious-to-light material, being circular approximately, and the surface thereof is painted with a facial-features pattern 23, allowing the present invention to form a human face modeling, but the present invention is not limited to the material and modeling mentioned above.

The secondary decoration 3 is different from the main decoration 2 in material. In the present embodiment, the secondary decoration 3 is made of cloth, being a hat modeling correspondingly to the main decoration 2 and configured on the top of the main decoration 2, but the present invention is not limited to the configuration mentioned above, a fixing way such as bonding, screwing, or stapling is also included. Furthermore, the present invention is further configured with another secondary decoration 3, being a scarf modeling put around the bottom of the main decoration 2, and the secondary decoration 3 is further configured with a small bell B, which can be shaken to sound while a door, on which it is hung, is being opened.

Figure 2:
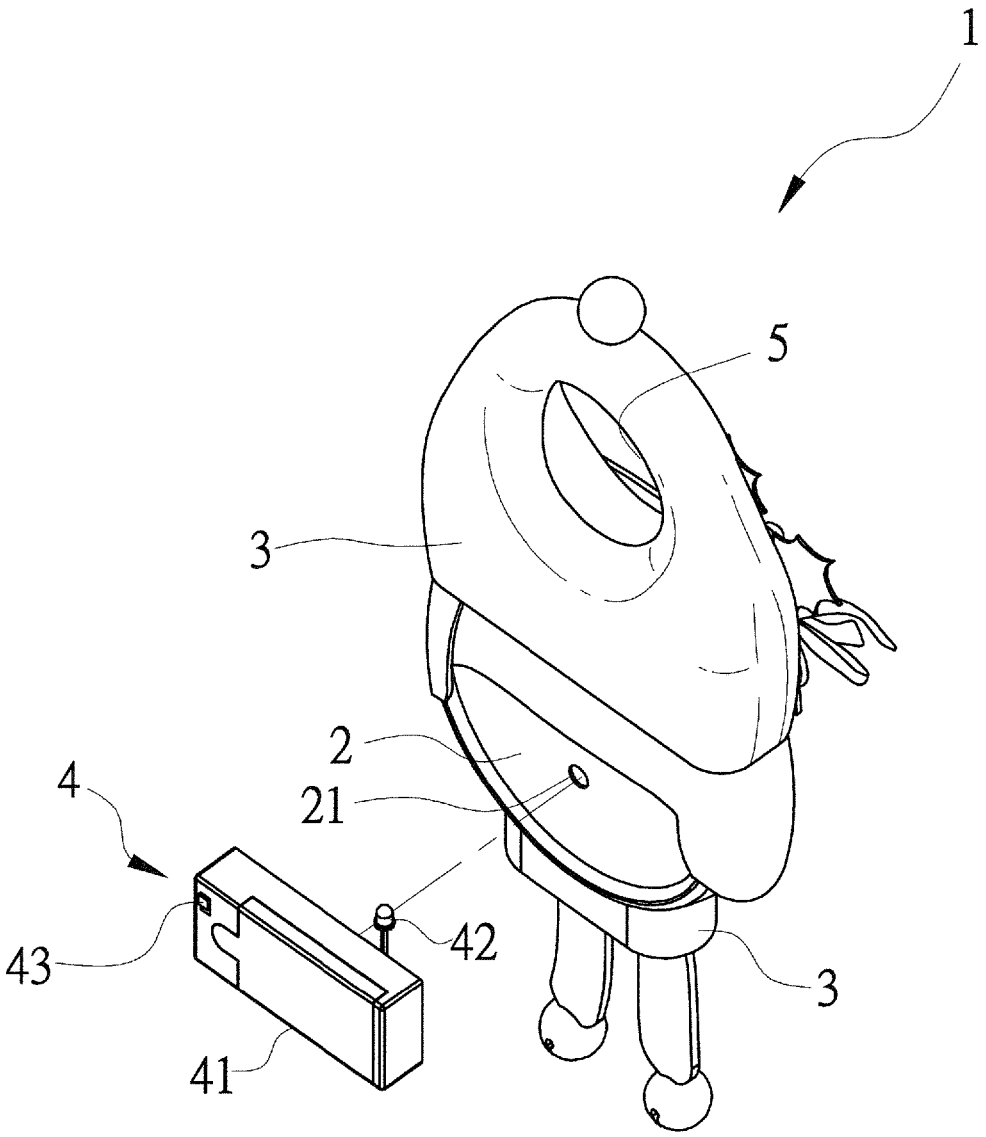
FIG. 2 is an exploded view of the present invention while being seen from the rear side thereof.
Figure 3:
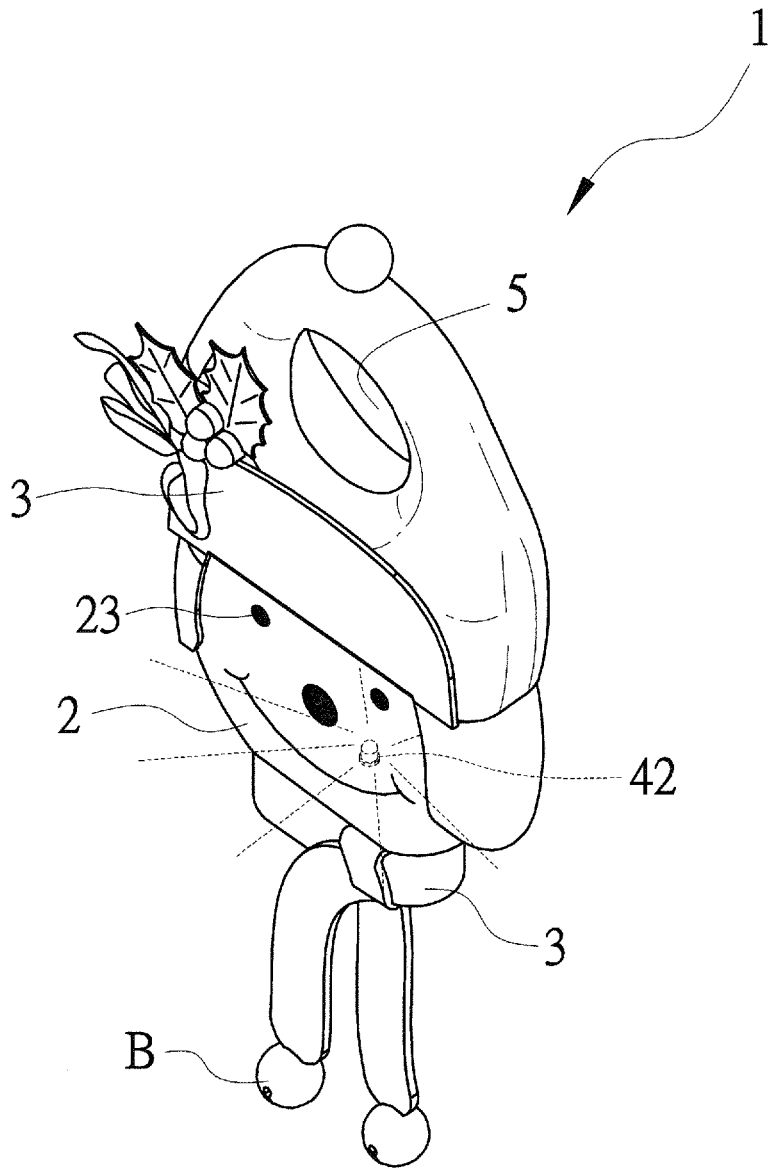
FIG. 3 is a perspective view of the embodiment of the present invention.
Figure 4:
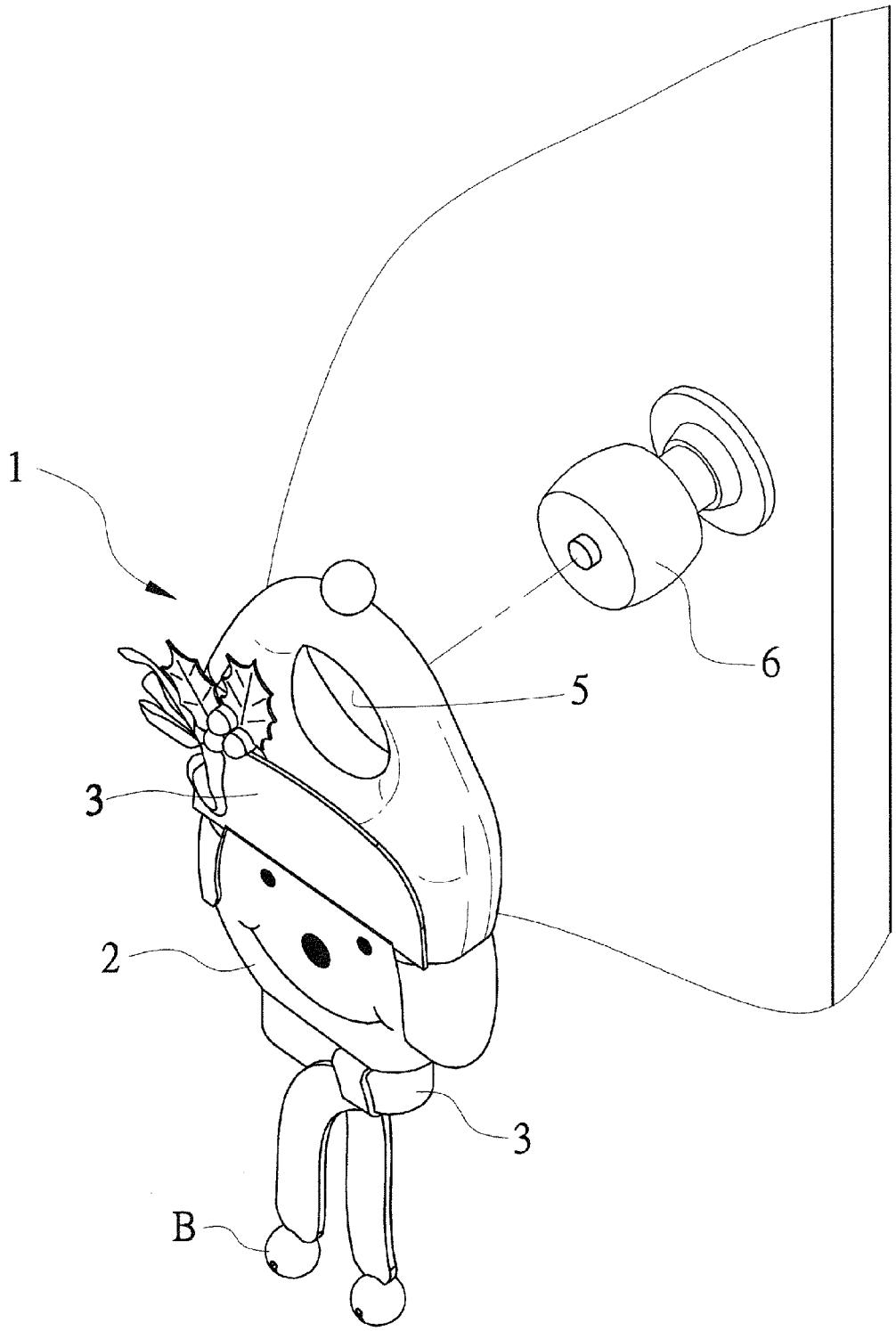
FIG. 4 is a perspective view of the present invention upon the implementation thereof.

The illumination device 4 has a power source portion 41, an illumination element 42 and a switch 43. Although the number of the illumination elements is not restrained, one illumination element is used in the present embodiment for convenient description. The illumination element 42 is mounted inside the accepting space 22 via the through hole 21 of the main decoration 2 and is in electric connection with the power source portion 41, capable of changing light color or twinkling intermittently. Furthermore, the power source portion 41 is configured on the outer rim of the main decoration 2, and adapted to shield the through hole 21; the power sourced portion 41 is connected to a battery to generate electricity to cause the illumination element 42 to light. Furthermore, the switch 43 is in electric connection with the power source portion 41, mainly adapted to switch on and off the illumination element 42; it can be a manual switch as FIG. 2 shows, tact switch or shaking switch, but because the variable patterns thereof are too many and the switch itself is conventional, the details thereof are omitted here.

The hanging portion 5 is configured above the main decoration 2. In the present embodiment, the hanging portion 5 is extended from the secondary decoration 3 to form an annular ring, adapted to hang on a door knob 6.

Figure 5:
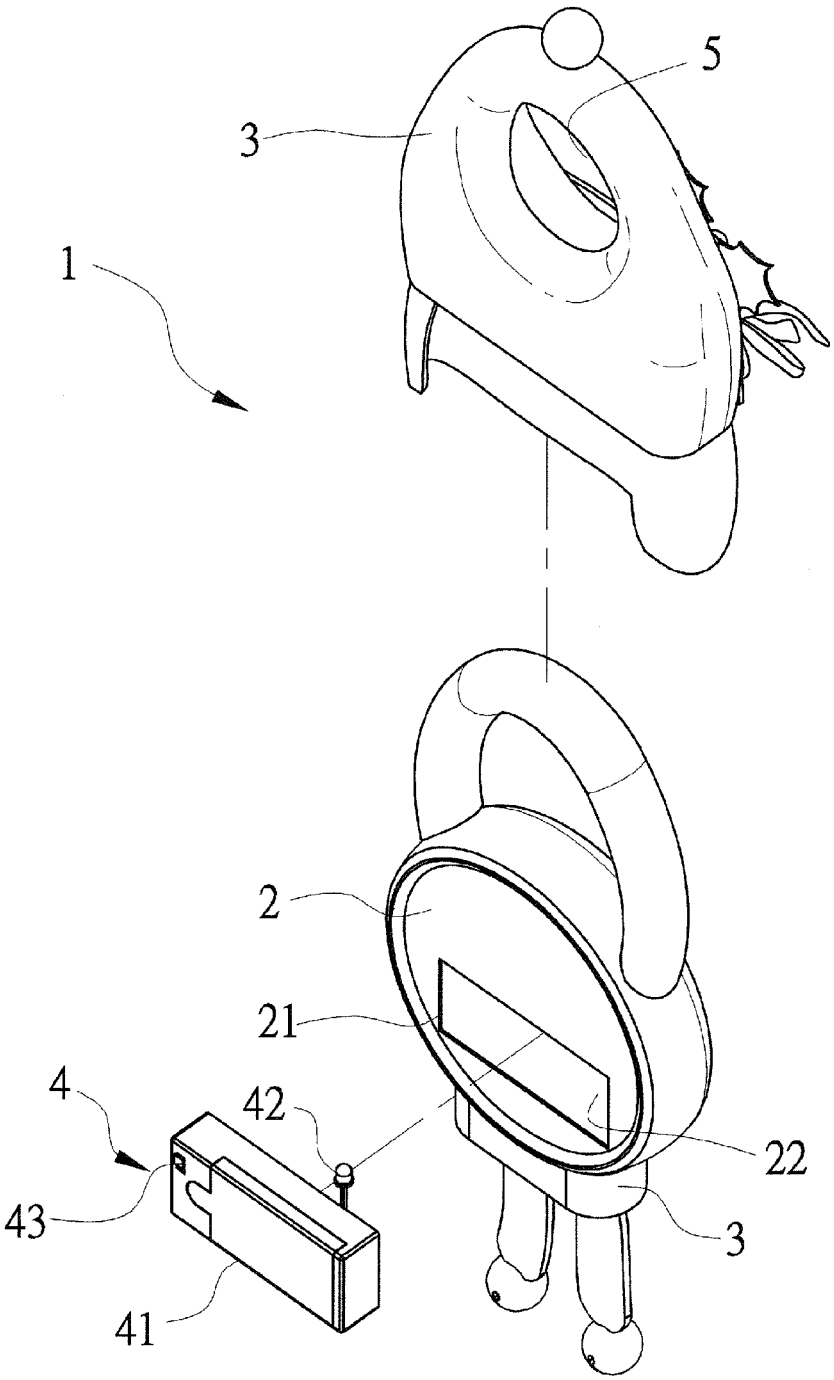
FIG. 5 is an exploded view of another preferred embodiment according to the present invention.
Figure 6:
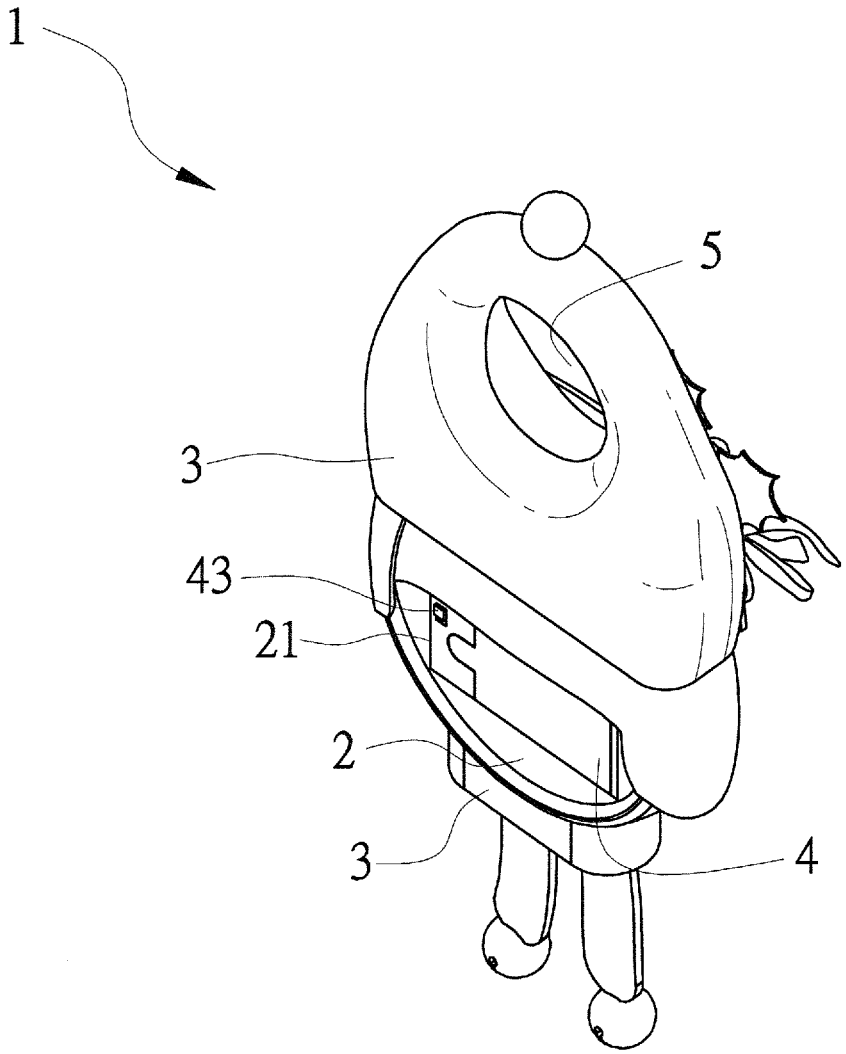
FIG. 6 is a perspective view of the embodiment according to the present invention.

Next, referring to FIGS. 5 and 6, the figures illustrates another preferred embodiment according to the present invention, the following only the difference between the present embodiment and the embodiment mentioned above is described. In the present embodiment, the hanging portion 5 is integrated with the main decoration 2 and is an annular ring extended from the upper side of the main decoration 2, and formed an 8-shaped body with the main decoration 2 approximately. Furthermore, the secondary decoration 3 is configured on the top of the main decoration 2, and covers the outer rim of the hanging portion 5. Furthermore, in the present embodiment, the power source portion 4 is configured inside the main decoration 2, and seals the through hole 21, i.e. the entire power source portion 4 is inlaid in the hole rim of the through hole 21.

Whereby, when the switch 43 is switched on and the power source portion 41 is conducted, the light emitted from the illumination element 42 transmits the main decoration 2, allowing the present invention to not only be hung on the door knob 6 as a decoration but have a illumination guidance function at night, as such, the decoration effect of the door hanger 1 is profited through the transmission of the illumination element 42.

I claim:

1. A twinkling door hanger, mainly comprising:

a main decoration, being a hollow, pervious-to-light shell, a through hole being formed on one side of said shell, an accepting space being formed by surrounding said accepting space with wall faces of said shell;

a secondary decoration, configured on a top of said main decoration, being different from said main decoration in material;

an illumination device, comprising a power source portion, in connection with a battery to generate electricity; at least one illumination element, configured in said accepting space; and a switch, adapted to switch on and off said illumination element, said illumination element and switch being in electric connection with said power source portion; and a hanging portion, configured on an upper side of said main decoration;

wherein said secondary decoration is formed of a flexible material and is mounted to said main decoration such that a portion of the flexible material completely encloses the hanging portion to provide a flexible surface layer covering a surface of the hanging portion.

2. The twinkling door hanger according to claim 1, wherein said hanging portion is extended from said secondary decoration.

3. The twinkling door hanger according to claim 1, wherein said hanging portion is extended from said main decoration.

4. The twinkling door hanger according to claim 1, wherein said power source portion is configured inside said main decoration.

5. The twinkling door hanger according to claim 1, wherein said power source is configured on an outer rim of said main decoration, and shields said through hole.

6. The twinkling door hanger according to claim 1, wherein said switch is a tact switch.

7. The twinkling door hanger according to claim 1, wherein said switch is a shaking switch.

8. The twinkling door hanger according to claim 1, wherein the flexible material comprises cloth.

* * * * *